US008690607B2

(12) United States Patent
Tsukamoto et al.

(10) Patent No.: US 8,690,607 B2
(45) Date of Patent: Apr. 8, 2014

(54) JOINT CONNECTOR

(75) Inventors: Masashi Tsukamoto, Kosai (JP); Yoshihiro Murakami, Kosai (JP)

(73) Assignee: Yazaki Corporation, Tokyo (JP)

( * ) Notice: Subject to any disclaimer, the term of this patent is extended or adjusted under 35 U.S.C. 154(b) by 49 days.

(21) Appl. No.: 13/569,823

(22) Filed: Aug. 8, 2012

(65) Prior Publication Data

US 2014/0045381 A1 Feb. 13, 2014

(51) Int. Cl.
*H01R 13/66* (2006.01)

(52) U.S. Cl.
USPC ..... 439/620.09

(58) Field of Classification Search
USPC ..... 439/620.09, 620.15, 620.16, 607.12, 439/620.07, 620.14; 29/876
See application file for complete search history.

(56) References Cited

U.S. PATENT DOCUMENTS

| | | | | | |
|---|---|---|---|---|---|
| 4,212,510 | A | * | 7/1980 | Ritchie et al. | 439/90 |
| 4,296,390 | A | * | 10/1981 | Vanderheyden et al. | 333/182 |
| 4,407,552 | A | * | 10/1983 | Watanabe et al. | 439/607.12 |
| 4,647,122 | A | * | 3/1987 | Kelly | 439/108 |
| 4,729,752 | A | * | 3/1988 | Dawson et al. | 439/620.16 |
| 4,804,332 | A | * | 2/1989 | Pirc | 439/620.09 |
| 5,081,434 | A | * | 1/1992 | Sakamoto et al. | 333/182 |
| 5,286,221 | A | * | 2/1994 | Fencl et al. | 439/607.53 |
| 5,415,569 | A | * | 5/1995 | Colleran et al. | 439/620.16 |
| 5,610,368 | A | * | 3/1997 | Smith | 174/355 |
| 5,823,827 | A | * | 10/1998 | Belopolsky | 439/620.06 |
| 6,059,608 | A | * | 5/2000 | Benes | 439/620.07 |
| 6,086,422 | A | * | 7/2000 | Glynn | 439/620.07 |
| 6,142,831 | A | * | 11/2000 | Ashman et al. | 439/620.15 |
| 6,467,165 | B1 | * | 10/2002 | Glynn | 29/876 |
| 6,837,747 | B1 | * | 1/2005 | Kosmala | 439/620.09 |
| 7,361,055 | B2 | * | 4/2008 | Fuerst | 439/620.09 |

FOREIGN PATENT DOCUMENTS

| | | | |
|---|---|---|---|
| JP | 2008-131327 | A | 6/2008 |
| JP | 2008-218038 | A | 9/2008 |
| JP | 2010-170985 | A | 8/2010 |
| WO | WO-2012/039510 | A1 | 3/2012 |

OTHER PUBLICATIONS

European Search Report dated Dec. 14, 2012, issued for the European patent application No. 12179679.1.

* cited by examiner

*Primary Examiner* — Alexander Gilman
(74) *Attorney, Agent, or Firm* — Edwards Wildman Palmer LLP

(57) ABSTRACT

For providing a joint connector which is miniaturized and general-purpose by designing an interval between needle shape terminal portions same as an interval between terminals of the general-purpose connector, the joint connector 1 includes a terminal 3 with a ferrite core 10, and a connector housing 2 receiving the terminal 3. The terminal 3 includes a busbar 28 and a plurality of needle shape terminal portions 29 extending from the busbar 28 at intervals along a direction of lengthwise of the busbar 28. The ferrite core 10 includes a first ferrite core 10*a* arranged at a base end 29*a* of the needle shape terminal portion 29 and a second ferrite core 10*b* arranged at an intermediate portion 29*b* of the needle shape terminal portion 29. The first ferrite core 10*a* and the second ferrite core 10*b* are arranged alternately at each of the plurality of needle shape terminal portions 29.

4 Claims, 4 Drawing Sheets

JOINT CONNECTOR

TECHNICAL FIELD

This invention relates to a joint connector.

BACKGROUND ART

A wiring harness is arranged in a car so as to transmit data about conditions of a control devise or an engine, a driving speed or failure diagnosis through CAN (Control Area Network). Such wiring harness is connected electrically to a plurality of sub harnesses. The sub harness includes a joint connector for separating an electric circuit.

The joint connector includes a ferrite component to remove noise overlapped on the data for reducing bad effect on transmitting data, which controls various electric unit mounted in the car through CAN communication, by noise radiation (for example, see patent documents 1-3).

The joint connector shown in patent documents 1-3 includes a connector housing to be fitted with a mating connector, and a terminal received in the connector housing so as to be electrically connected with a terminal of the mating connector. The terminal is formed by electrically conductive sheet metal and including a bar shape busbar, and a plurality of needle shape terminal portions extending from the busbar so as to be connected with the terminal of the mating connector. The terminal is provided at the needle shape terminal portions with a ferrite component to be inserted to the needle shape terminal portions.

CITATION LIST

Patent Document

Patent Document 1: Japan Patent Application Published No. 2008-218038

Patent Document 2: Japan Patent Application Published No. 2008-131327

Patent Document 3: Japan Patent Application Published No. 2010-170985

SUMMARY OF INVENTION

Objects to be Solved

According to the above usual joint connector shown in patent document 1, there is a problem that a structure of the joint connector becomes complicated by providing a plurality of through holes, through which the needle shape terminals are inserted, at the ferrite component, so that strict dimension control is required, and resulted in increasing cost. Furthermore, there is troublesome that the ferrite component formed specifically is required.

A usual joint connector shown in the patent document 2 or 3 is provided at a needle shape terminal portion with a ferrite component. Thereby, an interval between the needle shape terminal portions is wider than an interval between terminals of usual general-purpose connector, so that there is a problem that the joint connector becomes larger than the general-purpose connector.

According to the above problems, an object of the present invention is to provide a joint connector which has an interval between needle shape terminal portions, which insert through each ferrite component, same as an interval between terminals of a general-purpose connector, so as to be electrically connectable with the usual general-purpose connector, and is miniaturized.

How to Attain the Object of the Present Invention

In order to overcome the above problems and attain the object, the present invention is to provide a joint connector, which includes a terminal, a ferrite core arranged at the terminal, and a connector housing receiving the terminal, and in which the terminal includes a busbar and a plurality of needle shape terminal portions extending from the busbar at an interval along a lengthwise of the busbar, and the ferrite core includes a first ferrite core arranged at a base end of the needle shape terminal portion and a second ferrite core arranged at an intermediate portion of the needle shape terminal portion, and the first ferrite core and the second ferrite core are arranged alternately at each of the plurality of needle shape terminal portions.

The joint connector is further specified that the interval between the needle shape terminal portions is formed same as an interval between terminals of a general-purpose connector.

The joint connector mentioned above is further specified that the housing includes an inner housing in which the terminal is arranged, and an outer housing having an inner housing receiving section receiving the inner housing, and the inner housing includes a busbar receiving section receiving the busbar of the terminal and a first ferrite core receiving section receiving the base end of the needle shape terminal portion of the terminal and the first ferrite core, and a second ferrite core receiving section receiving the intermediate portion of the needle shape terminal portion and the second ferrite core, and the first ferrite core receiving section and the second ferrite core receiving section are arranged alternately about the plurality of needle shape terminal portions, and a first projection which projects toward the first ferrite core receiving section and opens a through hole which the needle shape terminal portion is inserted, and a second projection which projects toward the second ferrite core receiving section and opens a through hole which the needle shape terminal portion is inserted.

Effects of the Invention

According to the above-mentioned invention, the first ferrite core arranged at base end of the needle shape terminal portion and the second ferrite core arranged at the intermediate portion of the needle shape terminal portion are alternately provided about the plurality of needle shape terminal portions. Thereby, without changing dimensions of the first ferrite core and the second ferrite core, an interval between the needle shape terminal portions can be shortened. Therefore, the terminal including the needle shape terminal portions can be miniaturized and the joint connector can be miniaturized.

According to the above-mentioned invention, the interval between the needle shape terminal portions is formed same as the interval between terminals of the general-purpose connector. The joint connector can be connected with the general-purpose connector. Thus, the joint connector which is miniaturized and has capability of general-purpose can be provided.

According to the above-mentioned invention, the busbar of the terminal is received in the busbar receiving section of the first inner housing, and the first ferrite core is received in the first ferrite core receiving section, and the second ferrite core is received in the second ferrite core receiving section of the second inner housing, and the first ferrite core receiving section and the second ferrite core receiving section are provided alternately about the plurality of needle shape terminal portion. Thereby, without changing dimensions of the first ferrite core and the second ferrite core, an interval between the needle shape terminal portions can be shortened with a relative simple structure. Therefore, the joint connector, which is miniaturized with a simple structure, can be provided.

DESCRIPTION OF EMBODIMENTS

Figure 1:
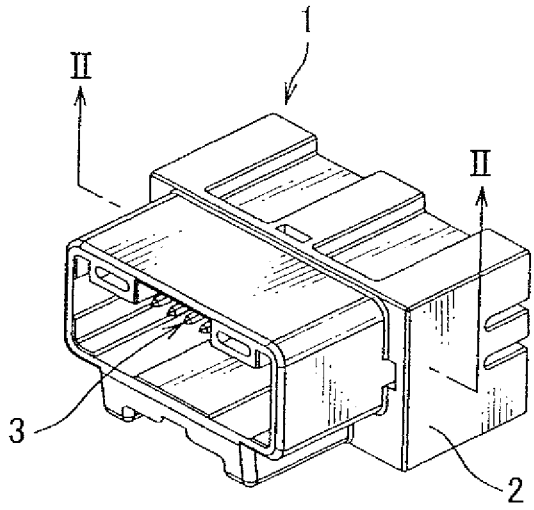
FIG. 1 is a perspective view of a first embodiment of a joint connector according to the present invention.
Figure 2:
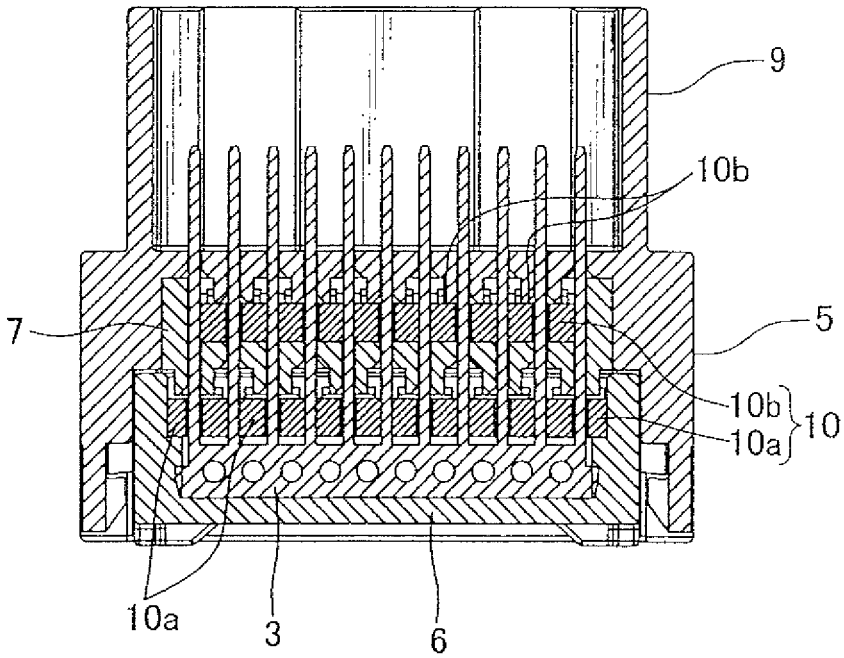
FIG. 2 is a cross-sectional view taken along the line II-II in FIG. 1.

FIGS. 1-6 show a first embodiment of a joint connector according to the present invention. As shown in FIGS. 1 and 2, the joint connector 1 of the embodiment according to the present invention includes a terminal 3 which is electrically connected with a terminal of a general-purpose connector 62 of a sub wiring harness 61 (shown in FIG. 5), and a connector housing 2 receiving the terminal 3 and being connected to the general-purpose connector.

Figure 3:
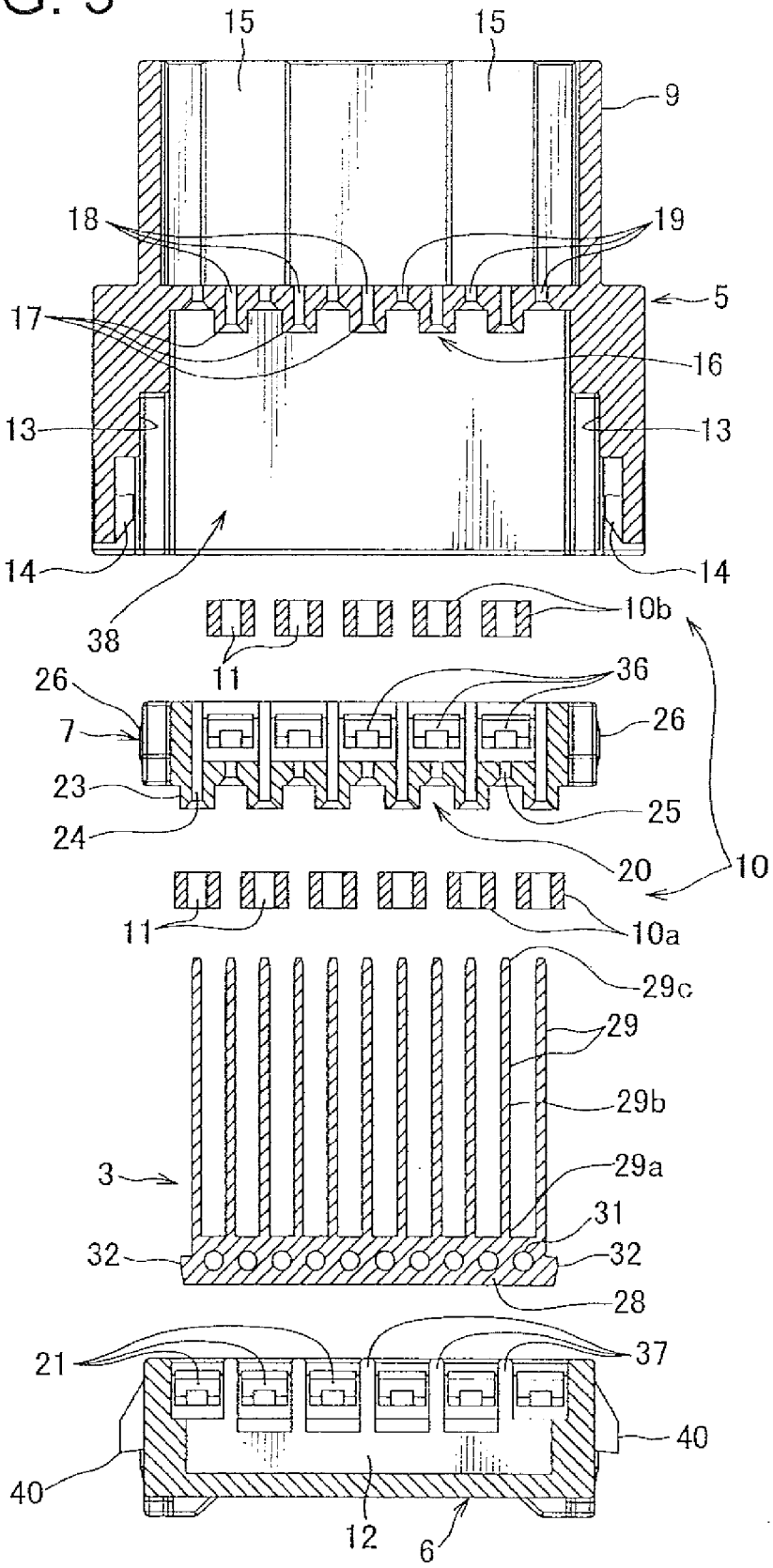
FIG. 3 is an exploded perspective view of the joint connector shown in FIG. 1.
Figure 4:
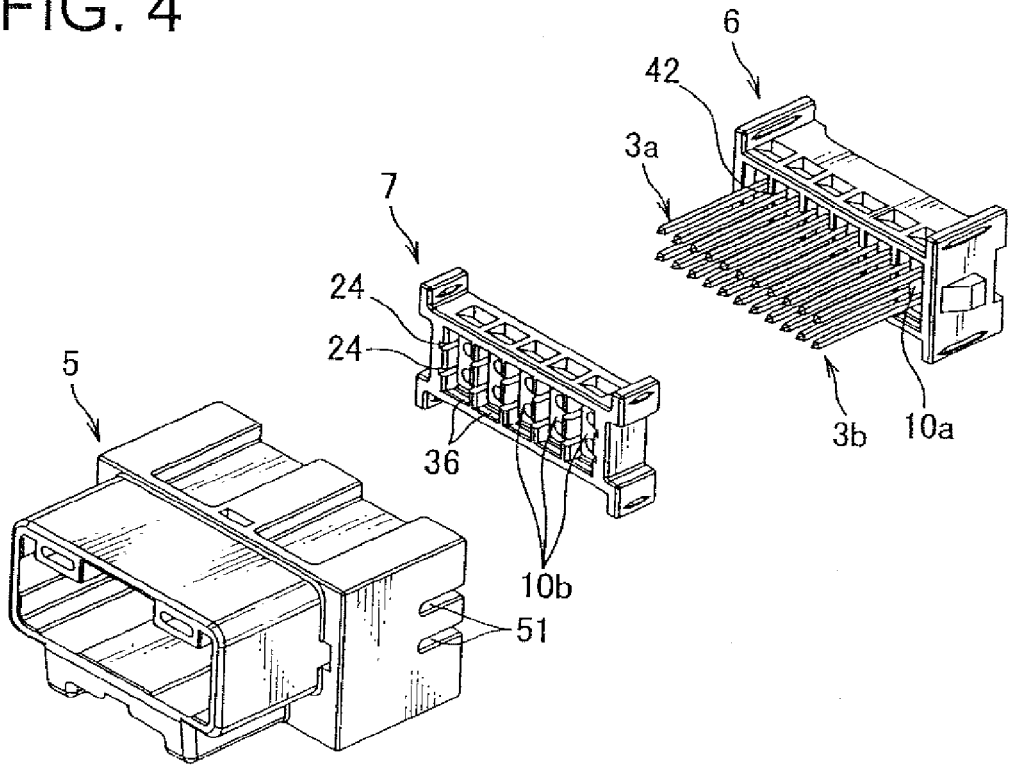
FIG. 4 is a perspective view for explaining assembling the joint connector shown in FIG. 1.
Figure 5:
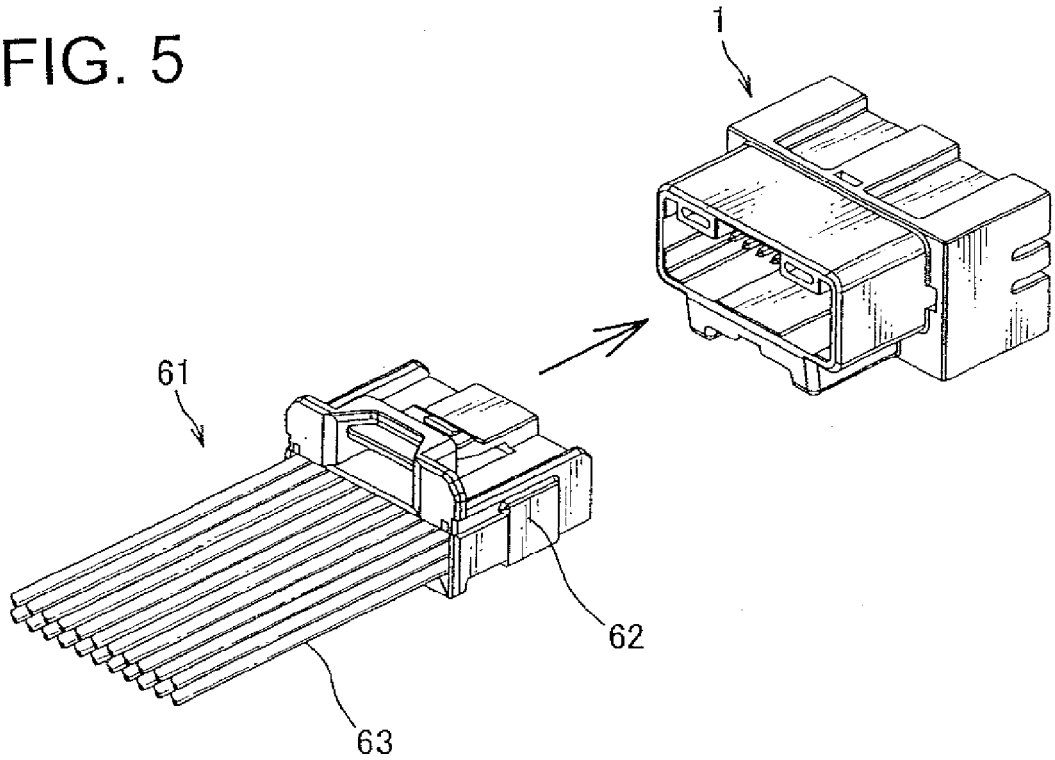
FIG. 5 is a perspective view for explaining connection of the joining connector shown in FIG. 1 and a mating connector.

The terminal 3 is formed into a comb shape by an electrically conductive metal sheet as shown in FIGS. 2 and 3. The terminal 3 includes a busbar 28 formed into a narrow bar plate, and a plurality of needle shape terminal portions 29 (11 pins for example) extending from the busbar 28 in a direction perpendicular to the busbar 28. The terminal 3 is formed by pressing. As shown in FIG. 4, a plurality of terminals 3*a*, 3*b* (2 sheet for example) is arranged in parallel to each other along a direction of thickness of the terminal 3.

In the busbar 28, a plurality of holes 31 (10 pieces for example) is arranged at even intervals along a lengthwise direction of the busbar 28. Engaging projections 32, 32 which are engaged with an inner wall of a busbar receiving section 12 of a later-described first inner housing 6 are provided at both ends along the lengthwise direction of the busbar 28. Projecting height of the engaging projection is configured to increase toward the needle shape terminal portions 29.

As shown in FIGS. 2 and 3, the needle shape terminal portions 29 are provided at even intervals in parallel to each other along the lengthwise direction of the busbar 28. Top end 29*c* of the needle shape terminal portion 29 is formed into a tapered shape so as to be inserted easily into a female terminal of the general-purpose connector. The needle shape terminal portion 29 is designed to have a length so as to connect electrically with the terminal of the general-purpose connector 62 when connect a connect portion 9 of the connector housing 2 and the general-purpose connector 62. An interval between the needle shape terminal portions 29 is designed same as an interval between the terminals of the general-purpose connector 62.

As shown in FIGS. 2 and 3, the connector housing 2 includes the first inner housing 6 in which the busbar receiving section 12 receiving the busbar 28 of the terminal 3 is formed; and a second housing 7 arranged in a row with the first inner housing 6; and an outer housing 5 receiving the first inner housing 6 and the second inner housing 7. The connector housing 2 is made of insulation synthetic resin such as polyvinyl chloride resin.

As shown in FIG. 4, the first inner housing 6 includes a plurality of first ferrite core receiving sections 21 (6 pieces in the embodiment) receiving a first ferrite core 10*a* which is arranged at a base end 29*a* of the needle shape terminal portion 29 of the terminal 3 and communicating with the busbar receiving section 12. The first inner housing 6 is provided at both ends along a lengthwise direction with lock projections 40, 40 to be engaged with lock hooks 14, 14 arranged at an inner housing receiving section 38 of the later-described outer housing 5.

As shown in FIGS. 2-4, a length of the busbar receiving section 12 is configured to engage the lock projections 32, 32 of the busbar 28 of the terminal 3, and a depth of the busbar receiving section 12 is configured to receive the two terminals 3*a*, 3*b* in parallel.

As shown in FIGS. 2 and 3, a plurality of first ferrite core receiving sections 21 (6 sections in the embodiment) is arranged in parallel with a lengthwise direction of the busbar 28 of the terminal 3 at even intervals along the lengthwise direction of the busbar 28. A plurality of through holes 37 (5 holes in the embodiment), which the needle shape terminal portion 29 of the terminal 3 is inserted through, is arranged between the first ferrite core receiving sections 21 adjacent to each other. As shown in FIG. 4, the first ferrite core receiving sections 21 is formed into rectangular shape, which each one of the needle shape terminal portions 29 of the two terminals 3*a*, 3*b* is inserted through, and the later-described first ferrite core 10*a* is received in. In the embodiment, each of the needle shape terminal portions 29 odd-numbered from an end of the terminal 3 is inserted through the first ferrite core receiving section 21.

As shown in FIGS. 2 and 3, the second inner housing 7 includes a plurality of first projections 23 (6 pieces in the embodiment) abutting the first ferrite core 10*a* received in the first ferrite core receiving section 21 of the first inner housing 6 so as to prevent rattle motion of the first ferrite core 10*a*; a plurality of through holes 24 (6 holes in the embodiment) communicating with the first projection 23 and inserting the needle shape terminal portion 29 of the terminal 3 therethrough; a second ferrite core receiving section 36 receiving the second ferrite core 10*b*, which is arranged between the through holes 24 at an intermediate portion 29*b* of the needle shape terminal portion 29, and inserts the needle shape terminal portion 29 of the terminal 3 through. The second inner housing 7 is provided at both ends thereof along a lengthwise direction of the second inner housing 7 with a convex portion 26 engaged with an inner wall of the inner housing receiving section of the outer housing 5.

The first projection 23, as shown in FIGS. 2 and 3, is configured to have a projection height so as to abut on the first ferrite core 10*a* received in the first ferrite core receiving section 21 of the first inner housing 6. The first projection 23 is arranged at an end of the through hole 24 which each of needle shape terminal portion 29 of the two terminals 3*a*, 3*b* is inserted through. Dimensional relation between the first projection 23 and the first ferrite core 10*a* can be adjusted suitably in any cases of abutting to each and not abutting.

The through hole 24 is formed into a round shape so as to insert the needle shape terminal portion 29 of the terminal 3.

Two rows of the through holes 24 are arranged so as to insert each of the needle shape terminal portions 29 of the two terminals 3*a*, 3*b*.

As shown in FIGS. 2 and 3, a plurality of the second ferrite core receiving sections 36 (5 sections in the embodiment) is arranged in parallel to the lengthwise direction of the busbar 28 of the terminal 3 at even interval along the lengthwise direction of the busbar 28. The through holes 24 are provided at both side walls of each of the second ferrite core receiving sections 36. The second ferrite core receiving section 36, as shown in FIG. 4, is formed into a rectangular shape, which each one of the needle shape terminal portions 29 of the two terminals 3*a*, 3*b* is inserted through, and the later-described second ferrite core 10*b* is received in. In the embodiment, each of the needle shape terminal portions 29 even-numbered from the end of the terminal 3 is inserted through the second ferrite core receiving section 36.

As shown in FIGS. 2 and 3, the outer housing 5 includes the connect portion 9 connecting with the above-mentioned general-purpose connector, and the inner housing receiving section 38 receiving the first inner housing 6 and the second inner housing 7.

As shown in FIG. 3, the connect portion 9 is formed into a cylindrical shape with a rectangular cross-section, and provided at an inner wall with a guide portions 15, 15 controlling mount direction for connecting with the general-purpose connector. The connect portion 9 is provided with an engaging portion engaging with a not-shown engaging member arranged at the general-purpose connector.

As shown in FIG. 3, the inner housing receiving section 38 includes lock hooks 14, 14 engaging with the lock projections 40, 40 formed at the both ends of the first inner housing 6, and inner surfaces 13, 13 pushed by the convex portions 26, 26 arranged at the both ends of the second inner housing 7, and a press portion 16 abutting on the second inner housing 7.

As shown in FIGS. 2 and 3, the lock hooks 14, 14 are arranged at the both side walls of the outer housing so as to increase projecting height along the taper surface of the lock projections 40, 40. As shown in FIG. 4, slits 51 are provided at the lock hooks 14, 14 so as to move the lock hooks 14, 14 flexibly.

A distance between the inner surfaces 13, 13 is configured to be slightly wider than a width of the second inner housing 7 and be wide so that the convex portions 26, 26 of the second inner housing 7 push the inner surfaces 13, 13.

The press portion 16 includes a plurality of second projections 17 (5 pieces in the embodiment) preventing rattle motion of the second ferrite core 10*b* received in the second ferrite core receiving section 36; and a plurality of through holes 19 (6 holes in the embodiment) arranged at both sides of the second projection 17 so as to insert the needle shape terminal portion 29 of the terminal 3 therethrough.

The second projection 17 is configured to have a projection height so as to abut on the second ferrite core 10*b* received in the second ferrite core receiving section 36. The second projection 17 is provided with a through hole 18 which each of needle shape terminal portion 29 even-numbered from the end of the two terminal 3 is inserted through.

The through hole 18 is formed into a round shape having a diameter so as to insert the needle shape terminal portion 29. Dimensional relation between the second projection 17 and the second ferrite core 10*b* can be adjusted suitably in any cases of abutting to each and not abutting.

The through hole 19 of the press portion 16 is formed into a round shape so as to insert the needle shape terminal portion 29 odd-numbered from the end of the terminal 3.

The ferrite core 10 includes the first ferrite core 10*a* and the second ferrite core 10*b*. As shown in FIGS. 2-4, the ferrite core 10 is formed into a cubic shape so as to have a plurality of through holes 11 (2 holes in the embodiment) which each of needle shape terminal portions 29 of the two terminals 3*a* and 3*b*. The first ferrite core 10*a* and the second ferrite core 10*b* correspond to a ferrite core for removing high frequency noise. The first ferrite core 10*a* and the second ferrite core 10*b* are made of known metallic oxide ferromagnetic material manufactured by known manufacturing method.

In the embodiment, the first ferrite core 10*a* is the ferrite core received in the first ferrite core receiving section 21 of the first inner housing 6, and the second ferrite core 10*b* is the ferrite core received in the second ferrite core receiving section 36 of the second inner housing 7. That is the same ferrite core is applied to the first ferrite core 10*a* and the second ferrite core 10*b*.

Each of the needle shape terminal portion 29 odd-numbered from the end of the terminal 3*a*, 3*b* is inserted through the first ferrite core 10*a* received in the first ferrite core receiving section 21 of the first inner housing 6. Each of the needle shape terminal portion 29 even-numbered from the end of the terminal 3*a*, 3*b* is inserted through the second ferrite core 10*b* received in the second ferrite core receiving section 36 of the second inner housing 7.

Assembling process of the joint connector 1 structured above will be described hereafter. The outer housing 5, the first inner housing 6, the second inner housing 7, the terminals 3*a*, 3*b*, the first ferrite core 10*a*, and the second ferrite core 10*b* are separately and previously manufactured.

As shown in FIG. 4, the terminals 3*a*, 3*b* are press-fitted into the first inner housing 6 and fixed therein. The plurality of first ferrite cores 10*a* is received in the plurality of first ferrite core receiving sections 21 of the first inner housing 6. Each of the needle shape terminal portion 29 odd-numbered from the end of the terminal 3*a*, 3*b* is inserted through the first ferrite core 10*a*.

Successively, each of the needle shape terminal portions 29 odd-numbered from the end of terminal 3*a*, 3*b* is inserted through the through hole 24 of each of the plurality of first projections 23 of the second inner housing 7, and each of the needle shape terminal portions 29 even-numbered from the end of the terminal 3*a*, 3*b* is inserted through the through hole 25 of each of the plurality of second ferrite core receiving sections 36 of the second inner housing 7. Thereby, the second inner housing 7 is arranged on the first inner housing 6. The first ferrite core 10*a* and the second ferrite core 10*b* are arranged in two stages at interval along the lengthwise direction of the needle shape terminal portion 29. Thus, each of the needle shape terminal portions 29 odd-numbered is inserted through the first ferrite core 10*a* and each of the needle shape terminal portions 29 even-numbered is inserted through the second ferrite core 10*b*. Therefore, the interval between the needle shape terminal portions 29 in the case can be reduced smaller than the interval when a plurality of ferrite cores is arranged in the same plane.

Successively, each of the plurality of second ferrite cores 10*b* is received in each of the plurality of second ferrite core receiving sections 36 of the second inner housing 7. At the time, each of the needle shape terminal portions 29 even-numbered from the end of the terminal 3*a*, 3*b* is inserted through the second ferrite core 10*b*.

The first inner housing 6 and the second inner housing 7 are inserted into and fixed in the inner housing receiving section 38 of the outer housing 5. At the time, the lock projections 40, 40 of the first inner housing 6 is engaged with the lock hooks 14, 14 of the inner housing receiving section 38, and the convex portions 26, 26 push the inner surface 13 of the inner housing receiving section 38, so that the first inner housing 6 and the second inner housing 7 are securely fixed in the outer housing 5.

The joint connector 1 assembled as shown above is connected with the sub harness 61 having a plurality of electric wires 63 (22 wires in the embodiment) and the general-purpose connector 62 (male connector) joined at an end of the plurality of electric wires 63. At the time, the interval of the terminal of the general-purpose connector 62 and the interval of the terminal 3 of the joint connector according to the present invention are designed to be the same value. Thereby, the general-purpose connector 62 can be fitted into the connect portion 9 of the joint connector 1 so that terminals of the both connectors can be electrically connected.

Figure 6:
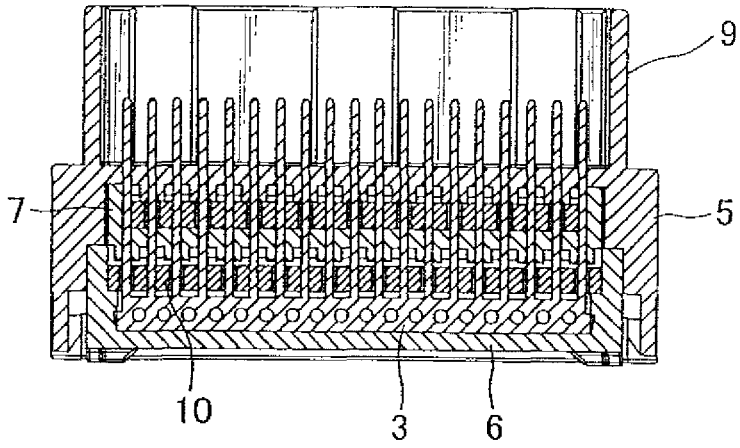
FIG. 6 is a cross-sectional view of one modification of the joint connector according to present invention.

In the embodiment, the joint connector 1 has 22 pins which is formed by two terminals 3*a*, 3*b* each having 11 pins of the needle shape terminal portions 29. As shown in FIG. 6, the joint connector 1 can have 38 pins formed by 19 pins of the needle shape terminal portions 29. Oppositely, the joint connector 1 can have smaller number of pins than 22 pins. For any number of pins, the joint connector according to the present invention maintains the dimensions of the ferrite core 10, and the interval between the needle shape terminal portions 29 of the terminal 3 is not changed, so that the joint connector 1 can be connected with the general-purpose connector 62. Number of pins of the joint connector 1 can be adjusted to that of the general-purpose connector 62.

According to the embodiment, the joint connector 1 includes the terminal 3 provided with the ferrite core 10, and the connector housing 5 receiving the terminal 3. The terminal 3 includes the busbar 28 and the plurality of needle shape terminal portions 29 extending from the busbar 28 at intervals along the direction of the lengthwise of the busbar 28. The ferrite core 10 includes the first ferrite core 10*a* arranged at the base end 29*a* of the needle shape terminal portion 29 and the second ferrite core 10*b* arranged at the intermediate portion 29*b* of the needle shape terminal portion 29. The first ferrite core 10*a* and the second ferrite core 10*b* are arranged alternately at the plurality of needle shape terminal portions 29. Furthermore, the interval between the needle shape terminal portions 29 is formed same as the interval between the terminals of the general-purpose connector 62.

Thus, The first ferrite core 10*a* arranged at the base end 29*a* of the needle shape terminal portions 29 and the second ferrite core 10*b* arranged at the intermediate portion 29*b* of the needle shape terminal portions 29 are arranged alternately at the plurality of needle shape terminal portions 29, so that without change the dimensions of the first ferrite core 10*a* and the second ferrite core 10*b*, the intervals between the needle shape terminal portions 29 can be shortened. Therefore, the terminal 3 provided with the needle shape terminal portions 29 can be miniaturized, so that the joint connector 1 can be miniaturized.

The interval between the needle shape terminal portions 29 is formed same as the interval between the terminals of the general-purpose connector 62, so that the joint connection has general-purpose performance so as to connect with the general-purpose connector 62. Thus, the joint connector which is miniaturized and general-purpose, can be provided.

The present inventions are described based in the embodiments as mentioned above, but the present invention is not limited in above embodiments. Various change and modifications can be made with the scope of the present invention.

REMARKS

1 Joint connector
2 Connector housing
3 Terminal
5 Outer housing
6 First inner housing
7 Second inner housing
10 Ferrite core
10*a* First ferrite core
10*b* Second ferrite core
12 Busbar receiving section
17 Second projection
18 Through hole
21 First ferrite receiving section
23 First projection
24 Through hole
28 Busbar
29 Needle shape terminal portion
36 Second ferrite receiving section

The invention claimed is:

1. A joint connector, comprising:

a terminal including a busbar and a plurality of needle shape terminal portions extending from the busbar at intervals along a direction of lengthwise of the busbar;

a ferrite core arranged at the terminal;

a connector housing receiving the terminal, wherein the ferrite core comprises a first ferrite core arranged at a base end of the needle shape terminal portion and a second ferrite core arranged at an intermediate portion of the needle shape terminal portion, and the first ferrite core and the second ferrite core are arranged alternately at each of the plurality of needle shape terminal portions.

2. The joint connector according to claim 1, wherein an interval between the needle shape terminal portions is configured to be same as an interval between terminals of a general-purpose connector.

3. The joint connector according to claim 1, wherein the connector housing comprises an inner housing, in which the terminal is arranged, and an outer housing having an inner housing receiving section receiving the inner housing, Wherein the inner housing comprises a first inner housing comprising a busbar receiving section receiving the busbar of the terminal, and a first ferrite core receiving section receiving the first ferrite core, wherein the base end of the needle shape terminal portion of the terminal is inserted through the first inner housing; and a second inner housing comprising a second ferrite core receiving section receiving the second ferrite core, wherein the intermediate portion of the needle shape terminal portion of the terminal is inserted through the second inner housing, and the first ferrite core receiving section and the second ferrite receiving section are arranged alternately at each of the plurality of needle shape terminal portions, wherein the second inner housing is provided with a first projection projecting toward the first ferrite core receiving section and opening a through hole which the needle shape terminal portion is inserted through, and the inner housing receiving section is provided with a second projection projecting toward the second ferrite core receiving section and opening another through hole which the needle shape terminal portion is inserted through.

4. The joint connector according to claim 2, wherein the connector housing comprises an inner housing, in which the terminal is arranged, and an outer housing having an inner housing receiving section receiving the inner housing, Wherein the inner housing comprises a first inner housing comprising a busbar receiving section receiving the busbar of the terminal, and a first ferrite core receiving section receiving the first ferrite core, wherein the base end of the needle shape terminal portion of the terminal is inserted through the first inner housing; and a second inner housing comprising a second ferrite core receiving section receiving the second ferrite core, wherein the intermediate portion of the needle shape terminal portion of the terminal is inserted through the second inner housing, and the first ferrite core receiving section and the second ferrite receiving section are arranged alternately at each of the plurality of needle shape terminal portions, wherein the second inner housing is provided with a first projection projecting toward the first ferrite core receiving section and opening a through hole which the needle shape terminal portion is inserted through, and the inner housing receiving section is provided with a second projection projecting toward the second ferrite core receiving section and opening another through hole which the needle shape terminal portion is inserted through.

* * * * *